US009120285B2

(12) United States Patent
Kodama

(10) Patent No.: US 9,120,285 B2
(45) Date of Patent: Sep. 1, 2015

(54) SHEET FEEDER OF CORRUGATED CARDBOARD SHEET BOX MAKING MACHINE

(71) Applicant: KABUSHIKI KAISHA ISOWA, Nagoya-shi, Aichi (JP)

(72) Inventor: Junichi Kodama, Kasugai (JP)

(73) Assignee: KABUSHIKI KAISHA ISOWA, Nagoya-shi (JP)

( * ) Notice: Subject to any disclaimer, the term of this patent is extended or adjusted under 35 U.S.C. 154(b) by 0 days.

(21) Appl. No.: 14/492,682

(22) Filed: Sep. 22, 2014

(65) Prior Publication Data

US 2015/0084275 A1 Mar. 26, 2015

(30) Foreign Application Priority Data

Sep. 26, 2013 (JP) ..... 2013-199173

(51) Int. Cl.

| | |
|---|---|
| ***B65H 5/06*** | (2006.01) |
| ***B31B 15/02*** | (2006.01) |
| ***B65H 5/04*** | (2006.01) |
| ***B65H 11/02*** | (2006.01) |
| ***B65H 3/06*** | (2006.01) |
| ***B65H 3/04*** | (2006.01) |

(52) U.S. Cl.

CPC ..... *B31B 15/02* (2013.01); *B65H 3/042* (2013.01); *B65H 3/063* (2013.01); *B65H 5/04* (2013.01); *B65H 5/062* (2013.01); *B65H 11/02* (2013.01); *B31B 2201/0276* (2013.01); *B65H 2511/224* (2013.01)

(58) Field of Classification Search

CPC ..... B65H 5/062; B65H 3/042; B65H 3/063; B65H 2511/224

See application file for complete search history.

(56) References Cited

U.S. PATENT DOCUMENTS

| | | | | |
|---|---|---|---|---|
| 5,029,845 A * | 7/1991 | Simpson-Davis | ..... | 271/262 |
| 5,203,846 A * | 4/1993 | Kuhns et al. | ..... | 271/125 |
| 5,542,571 A * | 8/1996 | Belka | ..... | 221/268 |
| 6,769,683 B2 * | 8/2004 | Hiramatsu | ..... | 271/274 |

FOREIGN PATENT DOCUMENTS

| | | |
|---|---|---|
| JP | A-3-39230 | 8/1991 |

* cited by examiner

*Primary Examiner* — Luis A Gonzalez
(74) *Attorney, Agent, or Firm* — Oliff PLC

(57) ABSTRACT

A sheet feeder of a corrugated paperboard box making machine includes a sheet feed table, feed rolls, an adjusting mechanism, a main unit, and a backing roller. The adjusting mechanism holds support plates pivotally supporting both ends of a first feed roll opposed to a second feed roll having an axis fixed to the main unit so as to allow an axis of the first feed roll to move with respect to the main unit. The support plates support a first backing roller via a connecting member connecting the support plates so that the first backing roller contacts with an outer peripheral surface of the first feed roll.

20 Claims, 8 Drawing Sheets

DD: Downstream Side UU: Upstream Side

SHEET FEEDER OF CORRUGATED CARDBOARD SHEET BOX MAKING MACHINE

CROSS-REFERENCE TO RELATED APPLICATIONS

This application is based upon and claims the benefit of priority from the prior Japanese Patent Application No. 2013-199173 filed on Sep. 26, 2013, the entire contents of which are incorporated herein by reference.

BACKGROUND OF THE INVENTION

1. Field of the Invention

The present invention relates to a sheet feeder of a corrugated paperboard box making machine for subjecting a sheet-shaped corrugated paperboard sheet to printing, creasing, slotting, and other processing and, more particularly, to a sheet feeder of a corrugated paperboard box making machine provided with a feed roll for feeding downstream corrugated paperboard sheets fed one by one from a stack of corrugated paperboard sheets on a sheet feed table.

2. Related Art

In general, a corrugated paperboard box making machine includes, from upstream to downstream, a sheet feeder for feeding various types of corrugated paperboard sheets, a printer for printing on a corrugated paperboard sheet fed thereto, a creaser-Blotter device for creasing and slotting a corrugated paperboard sheet to enable folding the sheet into a box shape, a die cut device for punching to form hand holes, and others. The sheet feeder is provided with feed rolls in upper and lower opposite positions to nip and feed downstream a corrugated paperboard sheet fed one by one from corrugated paperboard sheets stacked on a sheet feed table. The feed rolls are placed to extend in a direction perpendicular to a feeding direction of the corrugated paperboard sheets so as to allow a corrugated paperboard sheet having a maximum width among various types of corrugated paperboard sheets to pass between the feed rolls.

This pair of feed rolls is pivotally supported, at respective both ends in an axial direction, by a main unit and is rotated at high speed while nipping or pinching a corrugated paperboard sheet, fed between them, from above and below and in frictional contact with the corrugated paperboard sheet. Accordingly, each of the intermittently fed corrugated paperboard sheets strikes the feed rolls and then gets nipped between the feed rolls. Thus these feed rolls repeatedly receive a large impact force. This impact force causes a central part of each feed roll in the axial direction to be bent or warped in a direction to open a gap when the corrugated paperboard sheet passes between the rolls. After the corrugated paperboard sheet passes through the gap, the feed rolls are warped back to an original form. This warping vibration is repeated at high speed. If the feed rolls vibrate with large amplitude, some problems would occur; for example, scratches or indentations are generated on the surfaces of corrugated paperboard sheets and/or the feeding speed of the corrugated paperboard sheets varies.

Meanwhile, it is necessary to feed various types of corrugated paperboard sheets different in width, length in a feeding direction, thickness, flute shape, and others to the corrugated paperboard box making machine. Therefore, the sheet feeder is provided with an adjusting mechanism for adjusting a gap between the upper and lower feed rolls according to differences in thickness, flute shape, and so on of a corrugated paperboard sheet to be fed (e.g., see Patent Document 1).

The adjusting mechanism in Patent Document 1 is a mechanism in which an upper one of upper and lower feed rolls is rotatably attached to a main unit and a lower one is rotatably supported by an eccentric bearing case placed eccentrically with respect to an axis of the lower roll. This bearing case is rotatably attached to the main unit, so that the bearing case is rotated to adjust a gap between the upper and lower feed rolls.

In this case, since the upper roll is attached rotatably to the main unit, a center backing roller may be provided in the main unit so as to contact with an outer peripheral surface of a central part of the upper roll in the axial direction as mentioned above to reduce a bent or warped amount of the upper roll.

RELATED ART DOCUMENTS

Patent Documents

Patent Document 1: Japanese Examined Utility Model Application Publication No. 3-39230 (1991).

SUMMARY OF INVENTION

Technical Problems

However, the axis of the lower roll is moved together with the eccentric bearing case. Thus, a center backing roller could not be provided in the main unit so as to contact with an outer peripheral surface of a central part of the lower roll in the axial direction as with the upper roller.

Further, even if the center backing roller is coupled to the eccentric bearing case, when this bearing case being rotatably attached to the main unit is rotated, the center backing roller may interfere with the main unit.

In the case where the adjusting mechanism of Patent Document 1 is provided in the sheet feeder of the corrugated paperboard box making machine, consequently, the following problem would occur. Specifically, the center backing roller can be provided for the feed roll whose axis is fixed with respect to the main unit, whereas the center backing roller cannot be provided for the feed roll whose axis is movable with respect to the main unit.

The present invention has been made to solve the above problems and has a purpose to provide a sheet feeder of a corrugated paperboard box making machine, in which a backing roller is provided to contact with an outer peripheral surface of a feed roll whose axis is movable with respect to a main unit while avoiding interference with the main unit, thereby enabling reducing a warp amount of the feed roll caused when corrugated paperboard sheets intermittently pass between feed rolls.

Means of Solving the Problems

To achieve the above purpose, one aspect of the invention provides a sheet feeder of a corrugated paperboard box making machine, the sheet feeder including: a sheet feed table, feed rolls, a backing roller, and a main unit, the feed rolls being placed in the main unit in upper and lower opposite positions to feed downstream a corrugated paperboard sheet fed one by one from corrugated paperboard sheets stacked on the sheet feed table, and the sheet feeder further including an adjusting mechanism configured to adjust a gap between the feed rolls according to differences in thickness and flute shape of the corrugated paperboard sheet to be fed, wherein the adjusting mechanism includes support plates configured to pivotally support both ends of a first feed roll opposed to a second feed roll having an axis fixed to the main unit, the support plates being configured to allow an axis of the first feed roll to move with respect to the main unit, and the support plates support a first backing roller via a connecting member connecting the support plates so that the first backing roller contacts with an outer peripheral surface of the first feed roll.

According to the above configuration, including a backing roller provided to contact with an outer peripheral surface of a feed roll having an axis movable with respect to a main unit while avoiding interference with the main unit, it is possible to reduce a warp amount caused when corrugated paperboard sheets intermittently pass between feed rolls.

DESCRIPTION OF EMBODIMENTS

A detailed description of one embodiment of a sheet feeder of a corrugated paperboard box making machine embodying the present invention will now be given referring to the accompanying drawings. A configuration and an operating method of the sheet feeder in this embodiment is first explained, followed by an explanation of test results of measured displacement amounts of feed rolls during operation.

<Configuration and Operating Method of Sheet Feeding Device>

Figure 1:
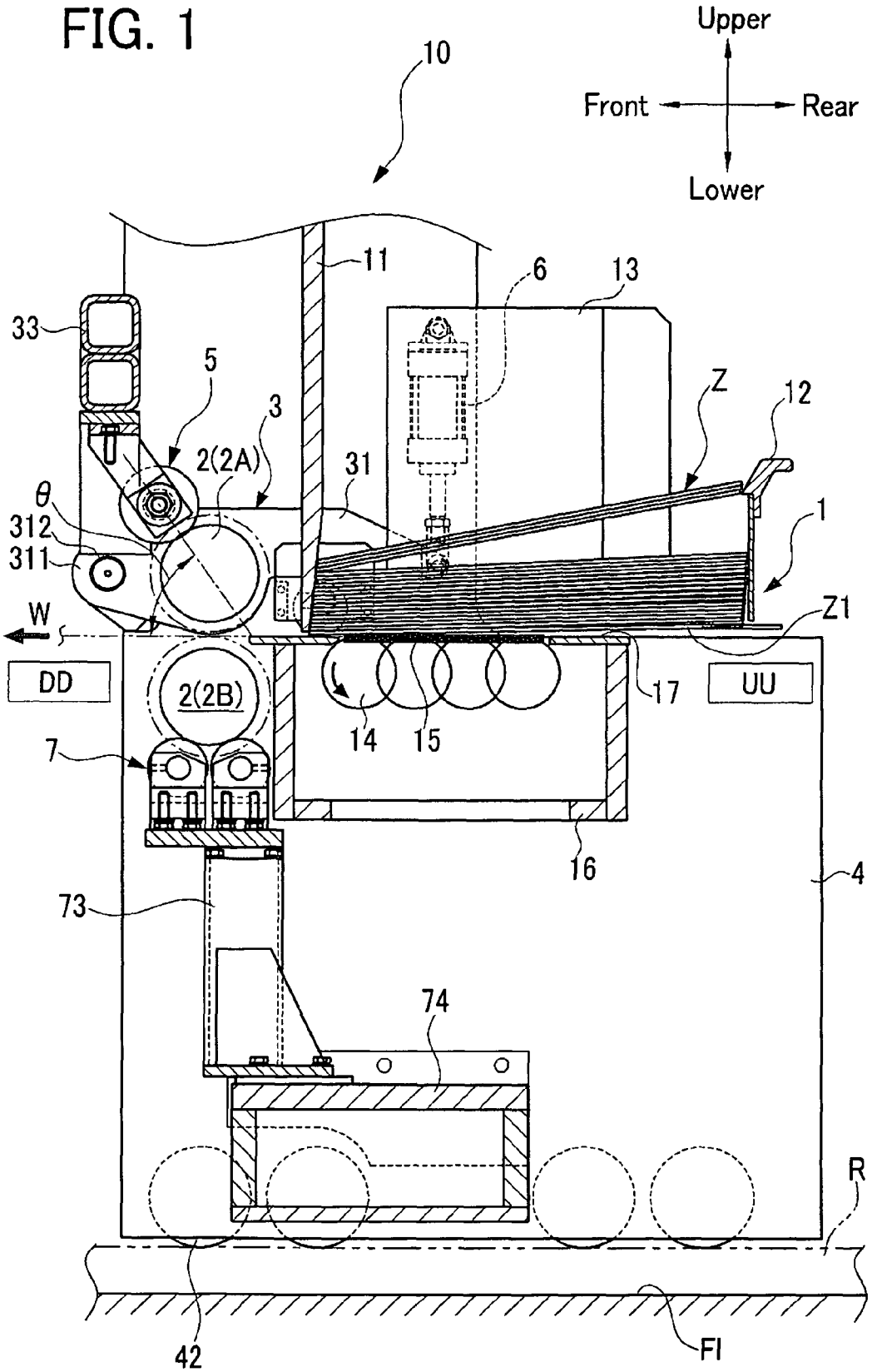
FIG. 1 is a side cross sectional view of a sheet feeder of a corrugated paperboard box making machine in an embodiment.
Figure 2:
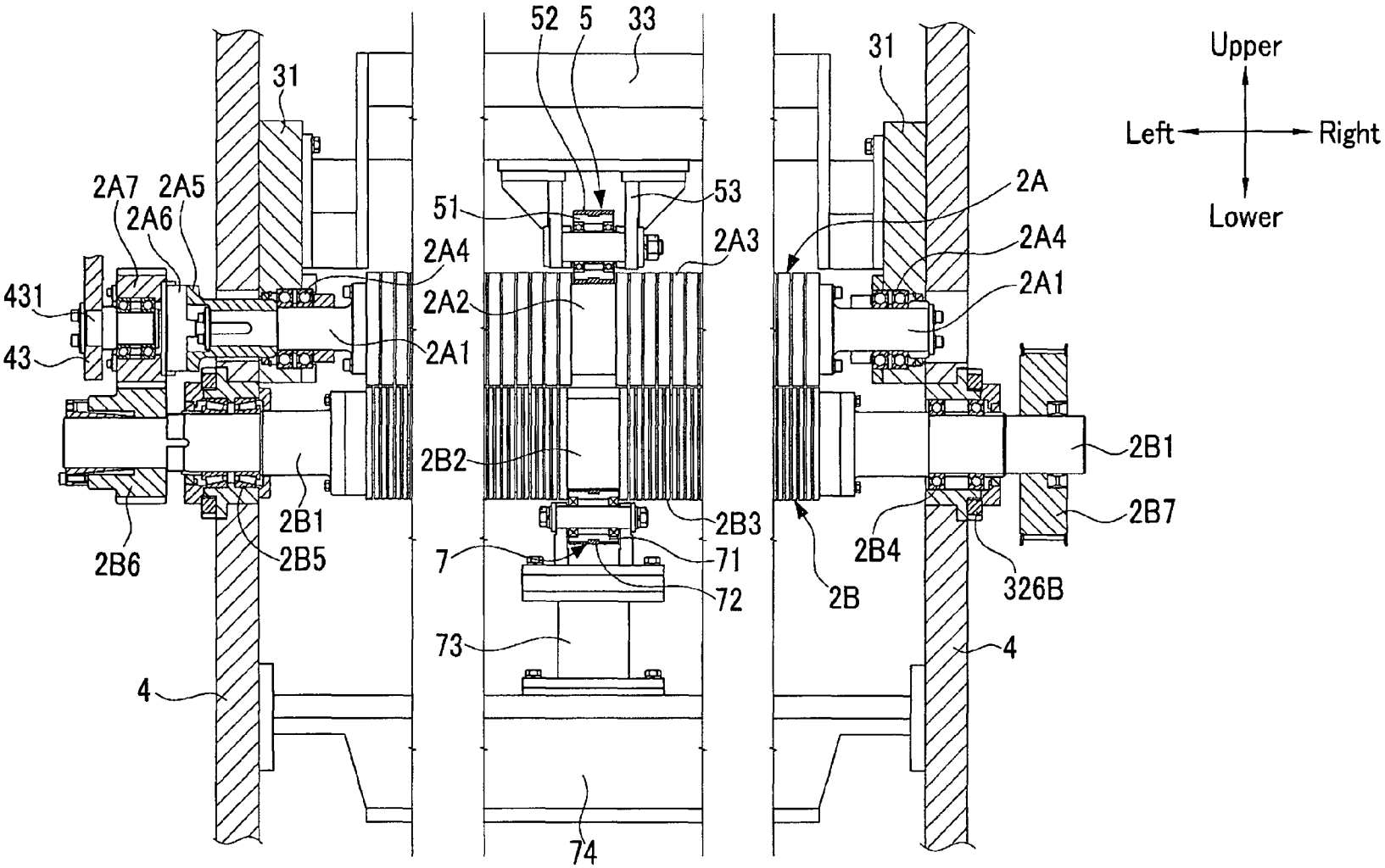
FIG. 2 is a partial cross sectional view of feed rolls and backing rollers of FIG. 1, seen from front in FIG. 1.
Figure 3:
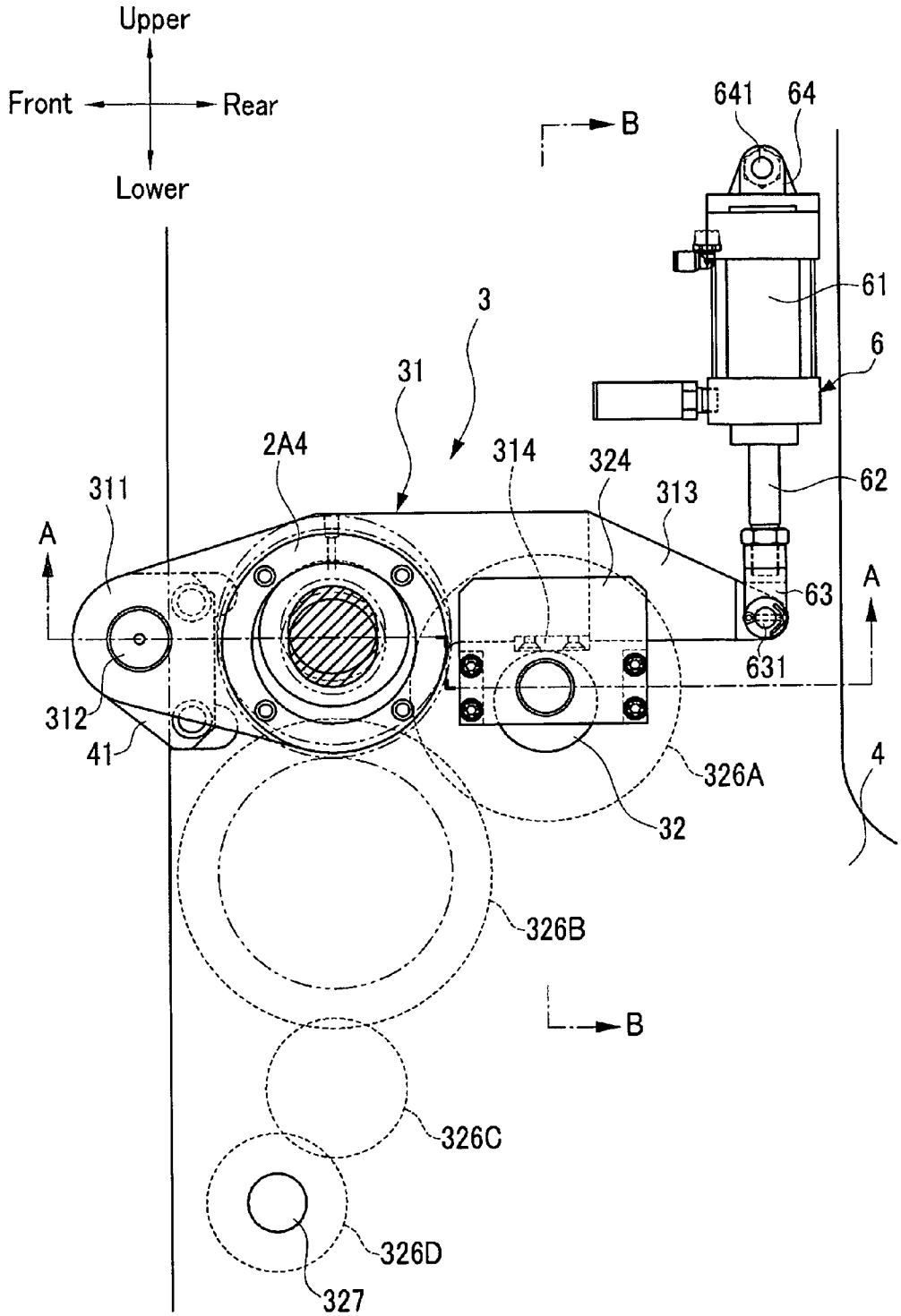
FIG. 3 is a side view of an adjusting mechanism for adjusting a gap between the feed rolls shown in FIG. 1.
Figure 4:
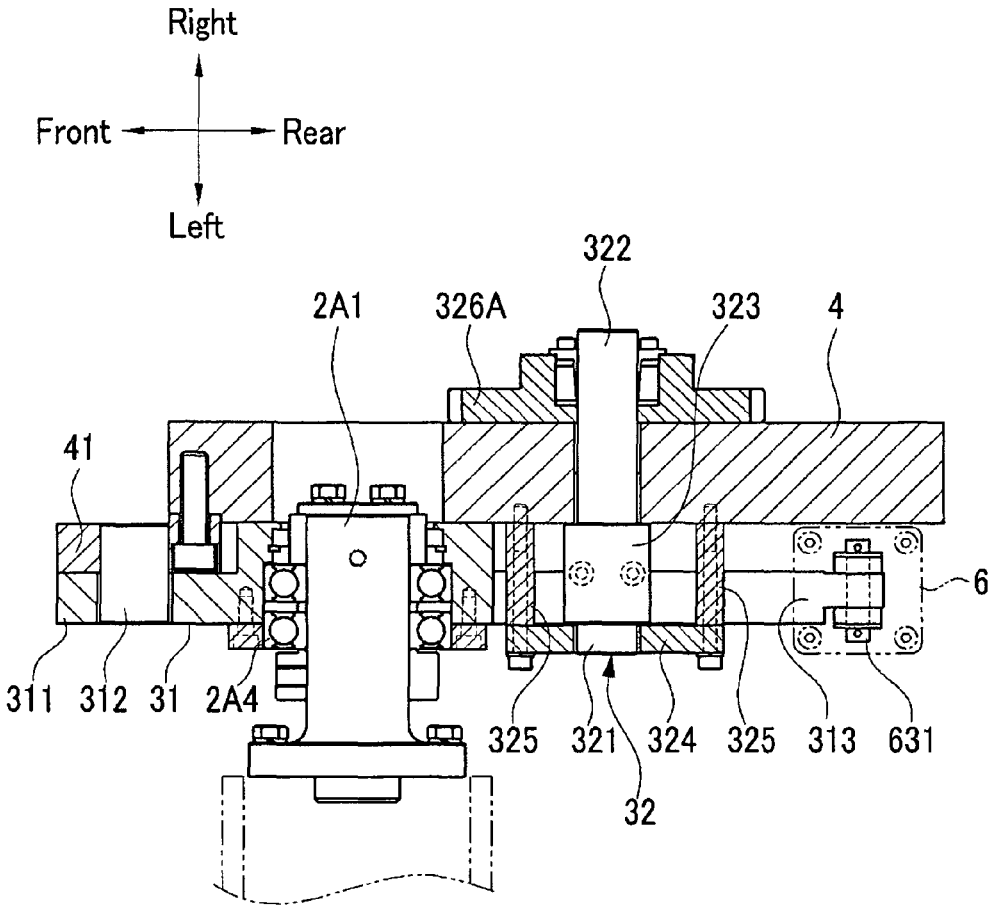
FIG. 4 is a cross sectional view taken along A-A in FIG. 3.
Figure 5:
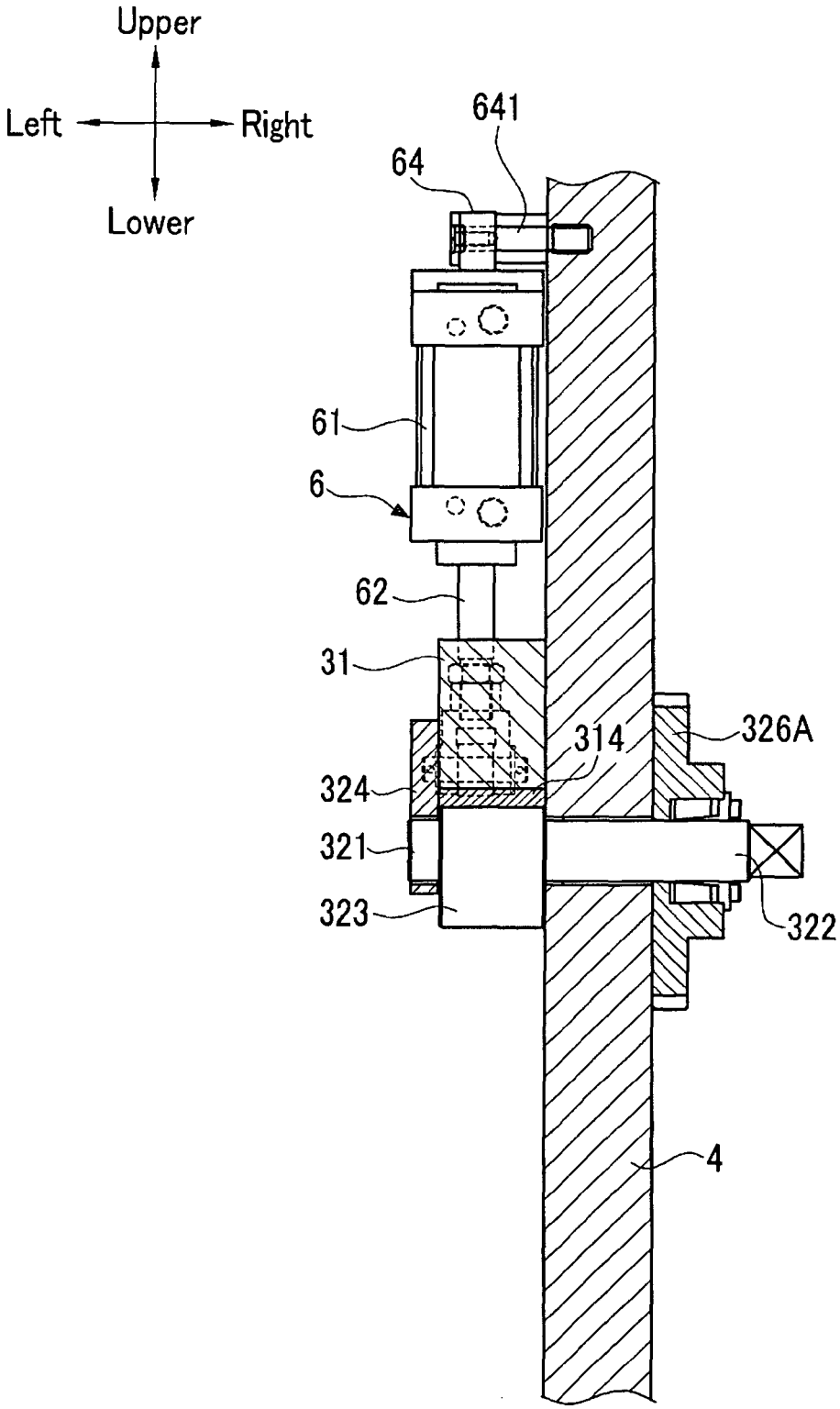
FIG. 5 is a cross sectional view taken along B-B in FIG. 3.

The configuration and the operating method of the sheet feeder in the present embodiment will be first described referring to FIGS. 1 to 5. FIG. 1 is a side cross sectional view of the sheet feeder of the corrugated paperboard box making machine in the present embodiment. FIG. 2 is a partial cross sectional view of feed rolls and backing rolls shown in FIG. 1, seen from front in FIG. 1. FIG. 3 is a side view of an adjusting mechanism for adjusting a gap between the feed rolls shown in FIG. 1. FIG. 4 is a cross sectional view taken along A-A in FIG. 3. FIG. 5 is a cross sectional view taken along B-B in FIG. 3.

As shown in FIG. 1, a sheet feeder 10 in this embodiment includes a sheet feed table 1, feed rolls 2 (2A, 2B), an adjusting mechanism 3, a main unit 4, a first backing roller 5, air pressure cylinders 6, and second backing rollers 7. The main unit 4 includes right and left side walls (see FIG. 2) each having a nearly L shape in side view. Between these right and left side walls of the main unit 4, there are housed the sheet feed table 1, the feed rolls 2 (2A, 2B), the adjusting mechanism 3, the first backing roller 5, the air pressure cylinders 6, and the second backing rollers 7. A plurality of wheels 42 are attached to lower ends of the side walls of the main unit 4, so that the main unit 4 can move on rails R laid on a floor surface F1 through the wheels 42.

(Sheet Feed Table)

The sheet feed table 1 is a device configured to hold a stack of sheet-shaped corrugated paperboard sheets Z aligned in an up-down direction and to supply a lowermost corrugated paperboard sheet Z1 to the feed rolls 2.

The sheet feed table 1 is provided with a table top 17 horizontally formed on which the corrugated paperboard sheets Z are stacked, and guide members 11, 12, and 13 arranged standing on the table top, at back and front, right and left sides, to guide the corrugated paperboard sheets Z to a feed position. Of the guide members, the front guide member 11 located at the front side of the table top 17 is a positioning reference to fix the corrugated paperboard sheets Z and is fixed to the main unit 4. Between the lower end of the front guide member 11 and the table top 17, a clearance is formed to allow passage of one corrugated paperboard sheet Z.

The rear guide member 12 located at the rear side of the table top 17 and the sides guide members 13 located at the right and left sides of the table top 17 are movable positioning references and thus attached to be movable in a horizontal direction with respect to the table top 17 in order to address various shapes of corrugated paperboard sheets Z. For example, a mechanism (not shown) for moving the side guide members 13 can be placed in the space located in front of the front guide member 11.

The sheet feed table 1 is provided with a plurality of sheet feed rolls 14 arranged in a zigzag pattern along an upper surface of the table top 17, a lifting plate 15 placed movable up and down with respect to the upper surface of the table top 17 so as to avoid interference with the sheet feed rolls 14, and a suction box 16 formed in a box-like shape under the table top 17. When the lifting plate 15 is moved down, the corrugated paperboard sheet Z1 comes into contact with the sheet feed rolls 14. On the other hand, when the lifting plate 15 is moved up, the corrugated paperboard sheet Z1 separates from the sheet feed rolls 14. The suction box 16 continuously sucks the sheet Z1 in a direction to close contact with the sheet feed rolls 14. A lower end of the suction box 16 is connected to a suction duct coupled to a suction device (not shown).

The corrugated paperboard sheets Z guided by the guide members 11, 12, and 13 are arranged so that front edge of lower surfaces slightly incline downward. While the lifting plate 15 is in a down position, a front lower surface of the lowermost corrugated paperboard sheet Z1 strongly contacts with the sheet feed rolls 14. When the sheet feed rolls 14 rotate in an arrow direction, the sheet Z1 is made to frictionally contact with the sheet feed rolls 14 and enter between the upper and lower feed rolls 2 (2A, 2B). The sheet feed rolls 14 intermittently rotate in sync with upward and downward movements of the lifting plate 15, thereby supplying each sheet Z1 located in a lowermost position to the feed rolls 2 (2A, 2B).

(Feed Roll)

As shown in FIGS. 1 to 2, the feed rolls 2 (2A, 2B) nip or pinch, from above and below, each corrugated paperboard sheet Z1 fed by the sheet feed rolls 14 and rotate at high speeds to feed the sheet Z1 in frictional contact therewith to a downstream side in the corrugated paperboard box making machine.

The feed rolls 2 (2A, 2B) are nearly cylindrical rolls opposed to each other in an up-down direction. The upper and lower feed rolls 2 (2A, 2B) include feeding parts 2A3 and 2B3 which will contact with a corrugated paperboard sheet and shafts 2A1 and 2B1 protruding from both ends of the corresponding feeding parts in the axial direction. Each of the feeding parts 2A3 and 2B3 consists of a metal roll attached, on its outer peripheral surface, with an elastic member formed with a plurality of grooves in a circumferential direction. Between the upper and lower feeding parts 2A3 and 2B3, a gap is formed through which the corrugated paperboard sheet Z will pass. At central parts of the feeding parts 2A3 and 2B3 in the axial direction, respectively, metal roll surface 2A2 and 2B2 (one example of an "outer peripheral surface") with predetermined widths are exposed. The first backing roller 5 contacts with the metal roll surface 2A2 of the upper feed roll 2A (one example of a "first feed roll") from an opposite side from the lower feed roll 2B (one example of a "second feed roll") to restrict vibration of the upper feed roll 2A. Furthermore, the second backing rollers 7 contact with the metal roll surface 2B2 of the lower feed roll 2B from an opposite side from the facing upper feed roll 2A to restrict vibration of the lower feed roll 2B. The first backing roller 5 and the second backing rollers 7 will be explained later.

As shown in FIG. 2, the shafts 2B1 of the lower feed roll 2B are pivotally supported by the main unit 4. To be concrete, a right shaft 2B1 has a middle part fitted in a bearing 2B4 fixed to the main unit 4, a distal end part engaged in a shaft drive pulley 2B7, and a proximal end part fastened to the feeding part 2B3. The shaft drive pulley 2B7 is coupled to a feed roll drive motor attached to the main unit 4 through a belt (not shown). A left shaft 2B1 has a middle part fitted in a bearing 2B5 fixed to the main unit 4, a distal end part engaged in a first connecting gear 2B6, and a proximal end part fastened to the feeding part 2B3. The first connecting gear 2B6 rotates integrally with the lower feed roll 2B.

The shafts 2A1 of the upper feed roll 2A are pivotally supported by support plates 31 of the adjusting mechanism 3 whose axis is moved in the up-down direction with respect to the main unit 4. The shafts 2A1 are also rotated in sync with the lower feed roll 2B. The adjusting mechanism 3 will be described later.

To be concrete, a right shaft 2A1 has a distal end part fitted in a bearing 2A4 fixed to the support plate 31 and a proximal end part fastened to the feeding part 2A3. The main unit 4 is formed with a relief hole for the right shaft 2A1. The left shaft 2A1 has a middle part fitted in a bearing 2A4 fixed to the support plate 31, a distal end part engaged in a universal joint 2A6 through a joint cylinder 2A5, and a proximal end part fastened to the feeding part 2A3. The joint cylinder 2A5 is fixed to the left shaft 2A1. The universal joint 2A6 is a joint that rotates while absorbing axis displacement when a gap between the upper and lower feed rolls changes. The joint cylinder 2A5 and the universal joint 2A6 can slide in a planar direction perpendicular to the axial direction. The universal joint 2A6 engages a second connecting gear 2A7 on an opposite side from the joint cylinder 2A5. The second connecting gear 2A7 is pivotally supported by an auxiliary bracket 43 connected to the main unit 4 through a shaft 431 protruding into the gear 2A7. This gear 2A7 meshes with the first connecting gear 2B6 in a radial direction. When the lower feed roll 2B is rotated, the upper feed roll 2A is rotated together. The rotational direction of the upper feed roll 2A is opposite to the rotational direction of the lower feed roll 2B.

(Adjusting Mechanism)

As shown in FIGS. 3 to 5, the adjusting mechanism 3 is provided with the support plates 31 and eccentric cams 32. This adjusting mechanism 3 is arranged to rotate the eccentric cams 32 to thereby move the support plates 31 pivotally supporting the shafts 2A1 of the upper feed roll 2A, upward and downward with respect to the main unit 4, thereby adjusting a gap between the upper and lower feed rolls.

Each support plate 31 is a plate-shaped member extending in a front-back direction. A front end portion 311 of each support plate 31 is pivotally supported, through a horizontal axis pin 312, on a nearly triangular block member 41 protruding forward from the main unit 4. The horizontal axis pin 312 protrudes from the block member 41 in a right-left direction.

A rear end portion 313 of each support plate 31 is pin-connected to an air pressure cylinder 6 (one example of a "fluid pressure cylinder"). The air pressure 6 is placed extending in the up-down direction with respect to the main unit 4. An upper end 64 of a cylinder case 61 is supported by a support pin 641 fixed to the main unit 4. A lower end 63 of a piston rod 62 protruding from bottom of the cylinder case 61 is connected to the rear end portion 313 of the support plate 31 through a connecting pin 631. The fluid pressure cylinder is not limited to the air pressure cylinder 6 and may be a gas pressure cylinder such as nitrogen gas. The fluid pressure cylinder is preferably provided with a damper mechanism.

A bearing 2A4 is attached between the front end portion 311 and the rear end portion 313 of each support plate 31 to pivotally support the shaft 2A1 of the upper feed roll 2A. Each support plate 31 is formed, at its lower end, with a circular-arc shaped holder part for the bearing 2A4 and a rear part thereof part extending horizontally. The rear part of the support plate 31 is fastened with a seat part 314 with which the eccentric cam 32 contacts. The eccentric cam 32 is preferably placed in a position away from the seat part 314 of the support plate 31 when the first backing roller 5 receives impact force from the corrugated paperboard sheet Z1. This is to avoid the impact force from the sheet Z1 from directly transmitting from the support plate 31 to the eccentric cam 32, enabling improving durability of the eccentric cam 32.

Each eccentric cam 32 is formed with a cam part 323 and shafts 321 and 322 extending rightward and leftward from the cam part 323. The cam part 323 has a circular outer periphery. The shafts 321, 322, and the cam part 323 are formed so that their axes are displaced from each other by a predetermined amount.

The shafts 321 and 322 are pivotally supported by the main unit 4 and an auxiliary plate 324 placed on a left side of the main unit 4. The auxiliary plate 324 is fastened in parallel to the main unit 4 through a spacer member 325. The cam part 323 is placed between the main unit 4 and the auxiliary plate 324.

On the shaft 322 protruding rightward from the main unit 4, an actuating gear 326A is fastened. The actuating gear 326A is coupled to a motor 327 for actuating an eccentric cam, the motor 327 being attached to the main unit 4 through intermediate gears 326B, 326C, and 326D. When the actuating motor 327 is actuated to rotate the intermediate gears 326B, 326C, and 326D and the actuating gear 326A, the cam part 323 of the eccentric cam 32 is rotated in contact with the seat part 314 of the support plate 31. As the cam part 323 is rotated, the support plate 31 is moved in the up-down direction.

(Backing Roller)

As shown in FIGS. 1 and 2, the sheet feeder 10 is provided with the first backing roller 5 to restrict vibration of the upper feed roll 2A and the second backing rollers 7 to restrict vibration of the lower feed roll 2B.

The first backing roller 5 and the second backing rollers 7 are roller members respectively placed to contact with the metal roll surfaces 2A2 and 2B2 of the upper and lower feed rolls 2(2A, 2B) from an opposite side from the corresponding feed roll 2 (2A, 2B) to restrict vibration of the feed rolls 2 (2A, 2B) that are displaced in a direction perpendicular to the axial direction.

The first backing roller 5 abuts against the metal roll surface 2A2 of the upper feed roll 2A from a front upper oblique side. The first backing roller 5 is arranged with at a predetermined inclined angle θ inclining obliquely upward with respect to a feeding direction W. This inclined angle θ is determined in consideration of the feeding speed of the feed roll 2, the thickness of the corrugated paperboard sheet Z1, the flute shape, and others and preferably set to on the order of 60 to 70 degrees. The impact force generated when the corrugated paperboard sheet Z1 passes through the gap between the upper and lower feed rolls 2 (2A, 2B) includes a force component that displaces the upper feed roll 2A upward (in a direction to widen the gap) and a force component that displaces the upper feed roll 2A forward (in the feeding direction W). Since the first backing roller 5 is formed at the predetermined inclined angle θ with respect to the feeding direction W, the impact force including the two force components can be reduced by one backing roller 5.

The first backing roller 5 is provided with a rotatable cylindrical roller body 51 and a support bracket 53 that pivotally supports both ends of the roller body 51. The outer peripheral surface of the roller body 51 is covered with an elastic member 52 having a predetermined thickness. This elastic member serves to absorb the impact force acting on the upper feed roll 2A. The elastic member 52 is preferably made of a hard urethane material. The hard urethane material can largely absorb the impact force of vibration transmitted from the metal roll surface 2A2 with less warp amount.

Preferably, the first backing roller 5 contacts with at least one portion of the outer peripheral surface 2A2 of a central part of the upper feed roll 2A in the axial direction. Since the warp amount of the upper feed roll 2A is maximum at the central part in the axial direction, the first backing roller 5 contacting with the outer peripheral surface 2A2 of the central part in the axial direction can restrict effectively the vibration.

A support bracket 53 of the first backing roller 5 is fastened to the lower end of the connecting member 33 connecting the both support plates 31 pivotally supported by both side walls of the main unit 4. The connecting member 33 is made of rectangular cylindrical members stacked in the up-down direction to enhance rigidity in the up-down direction. The connecting member 33 is configured such that a part located more inward than joints with the both support plates 31 protrudes to an upper front side of the upper feed roll 2A. This part can be fastened to the support bracket 53 and form the space between the connecting member 33 and the front guide member 11.

The second backing rollers 7 abut against the metal roll surface 2B2 of the lower feed roll 2B from back and front lower sides. The second backing rollers 7 are arranged two, back and forth in the feeding direction W. The impact force caused when the corrugated paperboard sheet Z1 passes through the gap between the upper and lower feed rolls 2 (2A, 2B) includes a force component that displaces the lower feed roll 2B downward (in a direction to widen the gap) and a force component that displaces the lower feed roll 2B forward (in the feeding direction W). The impact force including the above two force components can be reduced while the lower feed roll 2B is held by the two second backing rollers 7 arranged back and forth. Since the lower feed roll 2B is held from oblique lower sides by the two second backing rollers 7, it is possible to further effectively restrict the vibration of the lower feed roll 2B.

Each of the second backing rollers 7 is provided with a rotatable cylindrical roller body 71 and a support bracket 73 pivotally supporting both ends of the roller body 71. An outer peripheral surface of the roller body 71 is covered with a hard urethane material 72 having a predetermined thickness. The hard urethane material 72 can absorb more largely the impact force of vibration transmitted from the metal roll surface 2B2 with less warp amount.

The support bracket 73 of the second backing roller 7 is fastened to an upper end of a connecting member 74 connecting both side walls of the main unit 4. The connecting member 74 is rectangular in cross section.

Displacement Amount of Feed Roll During Operation

Figure 6:
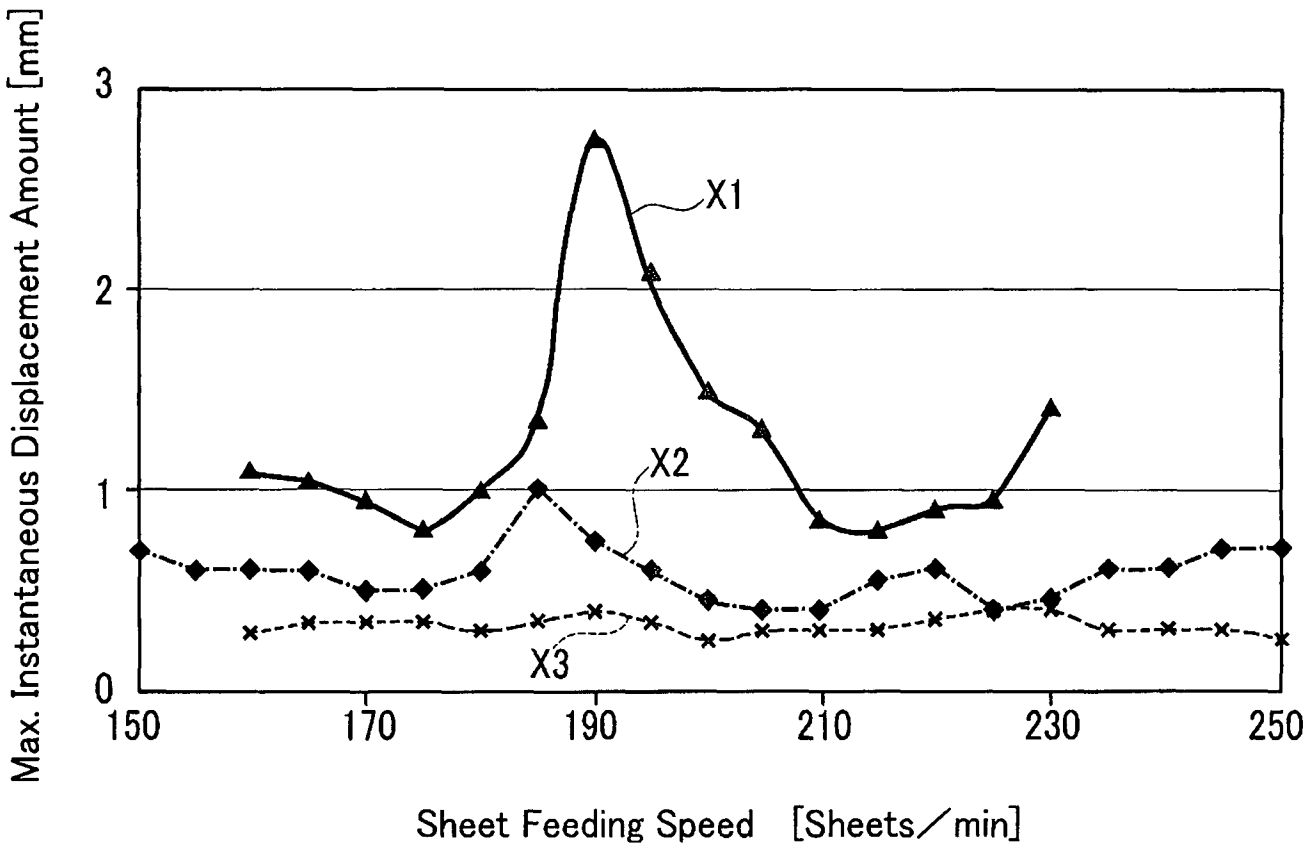
FIG. 6 is a graph showing test results by comparison of maximum instantaneous displacement amount of the feed rolls shown in FIG. 1.
Figure 7:
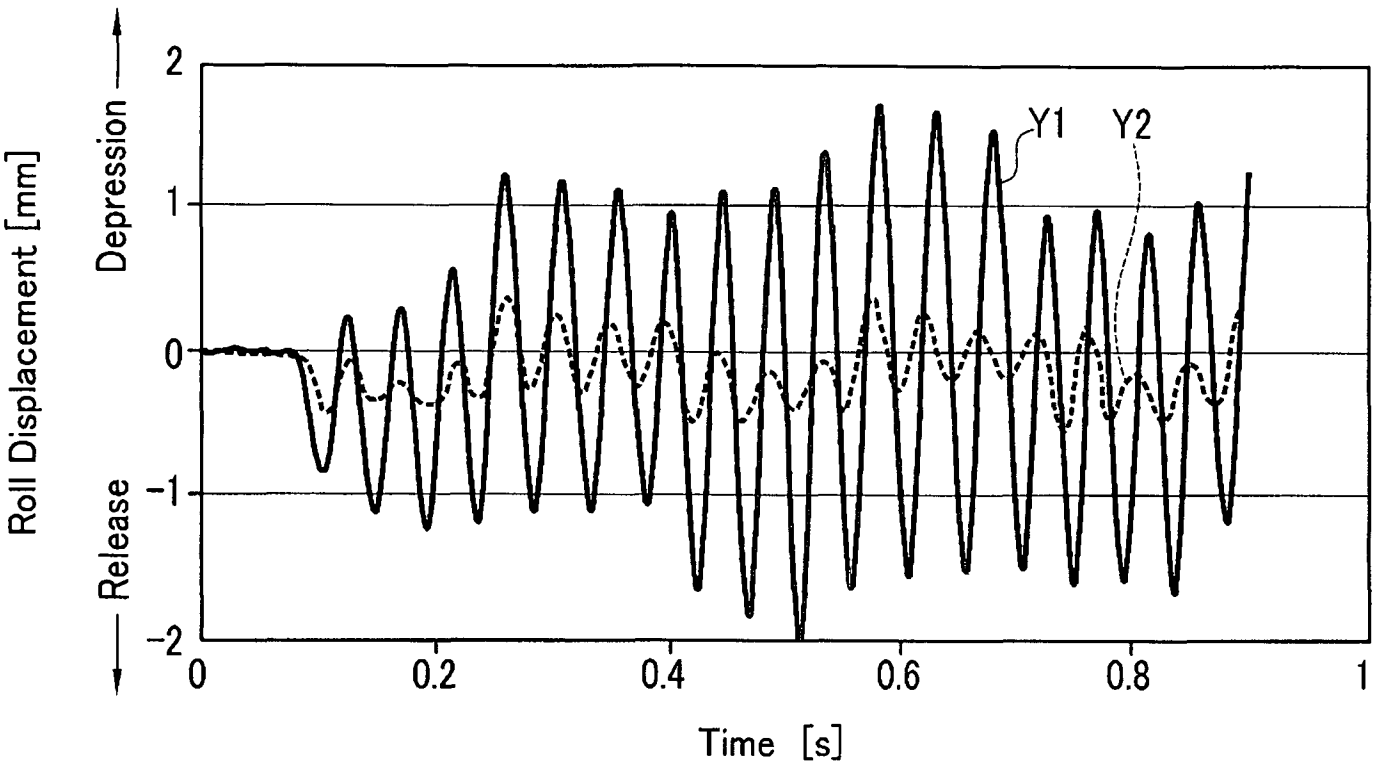
FIG. 7 is a graph showing test results by comparison of displacement amount of the feed rolls shown in FIG. 1 between a case of placing a backing roller for one of the feed rolls and a case of placing backing rollers for both of the feed rolls.
Figure 8:
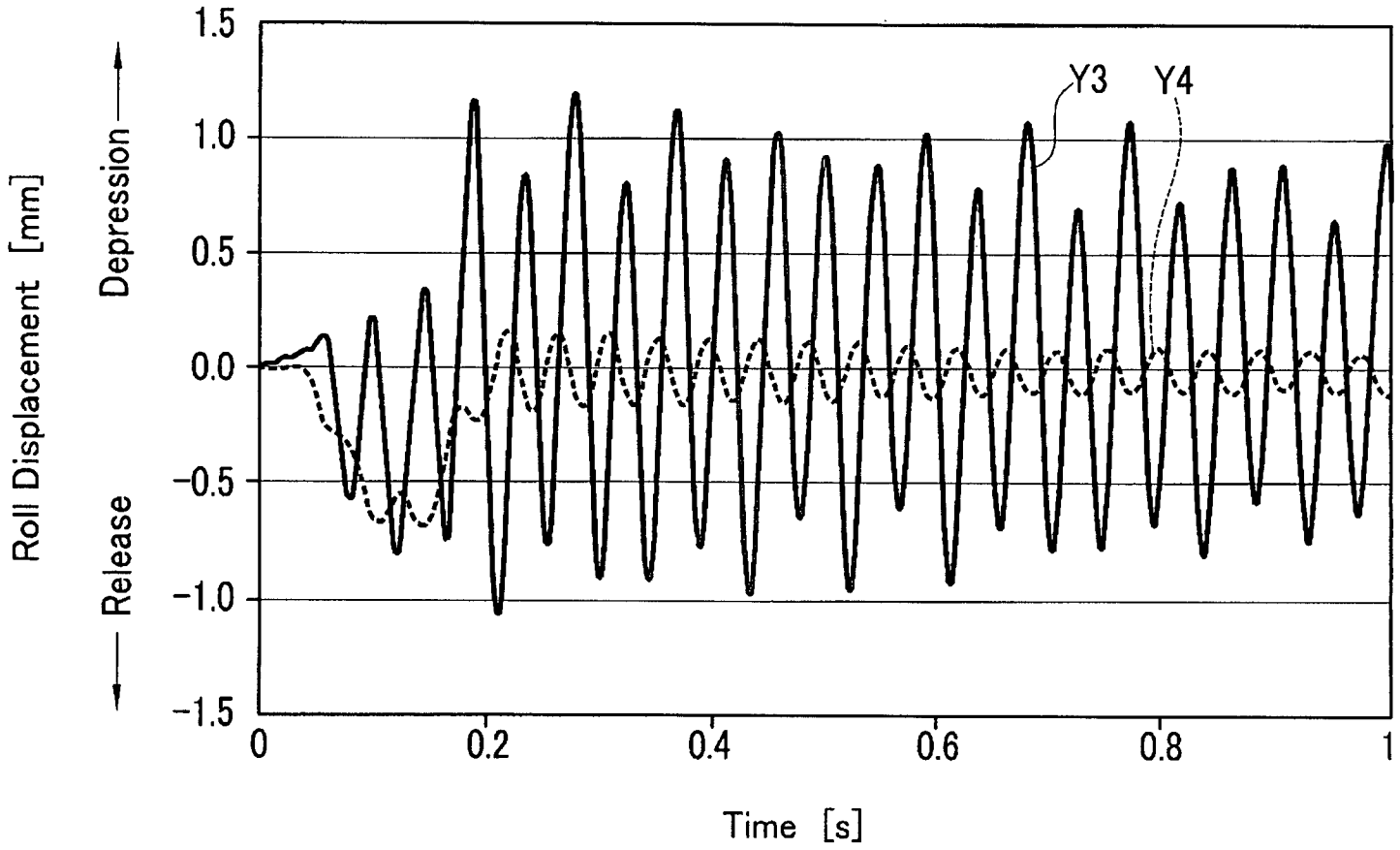
FIG. 8 is a graph showing test results by comparison of displacement amount of the feed rolls shown in FIG. 1 between a backing roller covered with a hard urethane material and a backing roller not covered with a hard urethane material.

A displacement amount of the feed rolls during operation is explained below referring to FIGS. 6 to 8. FIG. 6 is a graph showing test results by comparison of maximum instantaneous displacement amount of the feed rolls shown in FIG. 1. FIG. 7 is a graph showing test results by comparison of displacement amount of the feed rolls shown in FIG. 1 between a case of placing the backing roller for one of the feed rolls and a case of placing the backing rollers for both feed rolls. FIG. 8 is a graph showing test results by comparison of displacement amount of the feed rolls shown in FIG. 1 between the backing roller(s) covered with the hard urethane material and the backing roller(s) not covered with the hard urethane material.

(Maximum Instantaneous Displacement Amount of Feed Roll)

The maximum instantaneous displacement amount of the central part in the axial direction when warped while the both ends of the feed roll in the axial direction are fixed is compared between a case where the outer peripheral surfaces of the central parts of the upper and lower feed rolls in the axial direction are not restricted by the backing rollers, a case where only one of the feed rolls is restricted by the backing roller, and a case where both of the feed rolls are restricted by the backing rollers. Test results thereof are shown in FIG. 6. In the sheet feeder used herein, the outer diameter of each feed roll is 157 mm, and an inter-axis distance between the upper and lower feed rolls is 157 mm. Under the condition that the feeding speed of the corrugated paperboard sheets is changed finely every 5 sheets per minute from about 150 to 250 sheets per minute, the maximum instantaneous displacement amount in a direction perpendicular to the axial direction, of a central part of each feed roll in the axial direction, was measured at each feeding speed. The corrugated paperboard sheets used in this test were each about 5 mm in thickness and 1460 mm in width, and 593 mm in length in the feeding direction.

As shown in FIG. 6, when the outer peripheral surface of the feed roll was not restricted by the backing roller, the maximum instantaneous displacement amount X1 largely varied from about 0.8 to about 2.8 mm. In particular, when the feeding speed of the corrugated paperboard sheets was about 190 sheets per minute, the maximum instantaneous displacement amount X1 increased to about 2.8 mm. It is conceived that the feed rolls cause a resonance phenomenon at a feeding speed of about 190 sheets per minute.

In contract, when only one of the feed rolls was restricted by the backing roller, the maximum instantaneous displacement amount X2 fell within a range of about 0.4 to about 1.0 mm. In particular, when the feeding speed of the corrugated paperboard sheets was about 185 sheets per minute, the maximum instantaneous displacement amount X2 was about 1.0 mm, which is much smaller than that in the absence of restriction.

When both the upper and lower feed rolls were restricted by the backing roller, the maximum instantaneous displacement amount X3 further fell within a range of about 0.3 to about 0.4 mm. In particular, the resonance phenomenon occurring when the feeding speed of the corrugated paperboard sheets was about 185 to about 190 sheets per minute almost disappears, and vibration was greatly reduced as a whole.

The above results reveal that the maximum instantaneous displacement amount X of the feed roll could be greatly reduced by restriction of the outer peripheral surface of the feed roll by the backing roller. Further, it is confirmed that the resonance phenomenon of the feed roll could be suppressed.

(Time Change in Displacement Amount of Feed Roll)

The time change in displacement amount of the central part of each feed roll in the axial direction when warped while both ends of the feed roll are fixed is compared between a case where only one of the feed rolls is restricted by the backing roller and a case where both of the upper and lower feed rolls are restricted by the backing rollers. Test results thereof are shown in FIG. 7. In the sheet feeder used herein, the outer diameter of each feed roll is 157 mm and an inter-axis distance between the upper and lower feed rolls is 157 mm. The time change in displacement amount was measured at a corrugated paperboard sheet feeding speed of about 190 sheets per minute. The corrugated paperboard sheets used in the test were about 5 mm in thickness, 1460 mm in width, 593 mm in length in the feeding direction.

In the case where only one of the feed rolls was restricted by the backing roller, as shown in FIG. 7, a roll displacement (amplitude) Y1 was about 1.3 to about 3.4 mm. The roll displacement (amplitude) Y1 appears to periodically increase and decrease while leaning to a release direction or a depression direction with time.

In contrast, in the case where both of the upper and lower feed rolls were restricted by the backing rollers, a roll displacement (amplitude) Y2 was about 0.2 to about 0.6 mm. The roll displacement (amplitude) Y2 also appears to periodically increase and decrease while leaning to the release direction or the depression direction with time, but the amplitude thereof is greatly smaller than the above case.

The above results reveal that when the outer peripheral surfaces of the upper and lower feed rolls are restricted by the corresponding backing rollers, the displacement amount of each feed roll can be largely continuously reduced.

(Effects by Backing Roller Covered with Hard Urethane Material)

Regarding the time change in displacement amount of the central part of the upper feed roll in the axial direction when warped while the backing roller is placed to contact with the outer peripheral surface of the central part of the upper feed roll in the axial direction, the feed roll being pivotally supported at both ends to the support plates connected, at their front end portions, to the main unit and, at their rear end portions, to the air pressure cylinder supported in the main unit, amplitudes of the upper feed rolls are compared between the case where the outer peripheral surface of the backing roller was covered with the hard urethane material and the case where the outer peripheral surface of the backing roller was not covered. Test results thereof are shown in FIG. 8. In the sheet feeder used herein, the outer diameter of each feed roll is 157 mm and an inter-axis distance between the upper and lower feed rolls is 157 mm, measurement was made at a feeding speed of about 190 sheets per minute. The corrugated paperboard sheets used in the test is about 5 mm in thickness, 1278 mm in width, and length in the feeding direction is 448 mm.

In the case (iron) where no hard urethane material is present on the outer peripheral surface of the backing roller, as shown in FIG. 8, the roll displacement (amplitude) Y3 was about 1.5 to about 2.3 mm. The roll displacement (amplitude) Y3 appears with changing amplitude while a center position of vibration varies in each cycle to a release direction or a depression direction.

In contrast, in the case where the hard urethane material is present on the outer peripheral surface of the backing roller, the roll displacement (amplitude) Y4 was about 0.17 to about 0.3 mm. The roll displacement (amplitude) Y4 appears with largely reduced amplitude while a center position of vibration in each cycle does not vary.

From the above results, it is revealed that, regarding the time change in displacement amount of the central part of the upper feed roll in the axial direction, while the backing roller is placed to contact with the outer peripheral surface of the central part of the upper feed roll in the axial direction, both ends of the feed roll being pivotally supported by the support plates pivotally supported, at their front end portions, to the main unit and connected, at their rear end portions, to the air pressure cylinder supported by the main unit, the outer peripheral surface of the backing roller being covered with the hard urethane material can largely reduce the amplitude of the upper feed roll and also the center position of vibration can be made stable.

Effects of Present Embodiment

According to the present embodiment, the support plates 31 pivotally supporting both ends of the upper feed roll 2A are provided so that the axis of the upper feed roll 2A is movable with respect to the main unit 4. An amount of movement of the support plates 31 is equal to an amount of adjustment (generally, on the order of several millimeters) of the gap between the feed rolls.

Since the first backing roller 5 contacting with the outer peripheral surface (the metal roll surface 2A2) of the upper feed roll 2A is supported via the connecting member 33 connecting both the support plates 31, the upper feed roll 2A, the first backing roller 5, and the connecting member 33 can be integrally moved when the gap between the feed rolls is to be adjusted. A movement amount thereof is very small, equal to an adjustment amount (in general, on the order of several millimeters) of the gap between the feed rolls. Thus, even when the connecting member 33 and the first backing roller 5 are integrally moved, they are less likely to interfere with the main unit 4.

Since the first backing roller 5 is moved integrally with the upper feed roll 2A, there is no need to separately provide a dedicated device for driving the first backing roller 5. The first backing roller 5 can therefore be installed in a small space in the main unit 4. Furthermore, while contacting with the outer peripheral surface (the metal roll surface 2A2) of the upper feed roll 2A, the first backing roller 5 moves integrally with the upper feed roll 2A. Thus, the backing roller 5 can reliably restrict the warping force of the upper feed roll 2A due to the impact force caused when the corrugated paperboard sheet Z1 intermittently passes.

According to the present embodiment, since the first backing roller 5 has a predetermined inclined angle θ to the feeding direction W of the corrugated paperboard sheet Z1, the warping force of the upper feed roll 2A warped when the sheet Z1 passes therethrough can be reliably restricted by the single backing roller 5. Specifically, the first backing roller 5 is opposed to the upper feed roll 2A with the predetermined inclined angle θ to the feeding direction W of the sheet Z1, so that the first backing roller 5 can simultaneously receive both the warping force of the upper feed roll 2A in the feeding direction W and the warping force of the same in the vertical direction. Accordingly, it is possible to restrict vibration of the upper feed roll 2A with a smaller space and reduce the warp amount.

According to the present embodiment, the support plates 31 are pivotally supported at respective front end portions 311 to the main unit 4, so that each support plate 31 can rotate about a shaft (the horizontal axis pin 312) of the front end portion 311 with respect to the main unit 4. The support plates 31 are connected at respective rear end portions 313 to the air pressure cylinders 6 supported in the main unit 4. Accordingly, the impact force transmitted from the corrugated paperboard sheet Z1 to the first backing roller 5 is received by the air pressure cylinders 6 via the connecting member 33 and the support plates 31, and thus reduced by the air pressure cylinders 6, thereby enabling restricting the vibration of the upper feed roll 2A.

According to the present embodiment, furthermore, the eccentric cams 32 pivotally supported by the main unit 4 abut against the support plates 31 and therefore rotation of the eccentric cams 32 can easily move the support plates 31 by the principle of leverage. The adjusting mechanism 3 of the upper feed roll 2A can thus be made more compact. This compact adjusting mechanism 3 enables more reliably ensuring the space for placing the first backing roller 5 and the connecting member 33 in the main unit 4.

Modified Examples

The present invention is not limited to the above embodiment and may be embodied in other specific forms without departing from the essential characteristics thereof.

In aforementioned embodiment, the first backing roller 5 that restricts the vibration of the upper feed roll 2A is opposed to the upper feed roll 2A at the predetermined inclined angle θ to the feeding direction W of the corrugated paperboard sheet Z1. However, the invention is not limited thereto. For instance, if there is a space for placing more than one backing roller, two backing rollers may be arranged before and behind the upper feed roll 2A in a similar manner to the second backing rollers 7 contacting the lower feed roll 2B. This is to more effectively restrict the vibration of the upper feed roll 2A.

The aforementioned embodiment exemplifies that the upper feed roll 2A and the lower feed roll 2B are provided in one pair. The invention is however not limited thereto. For instance, the invention is also applicable to the case where a plurality of feed rolls are provided in the feeding direction W of the corrugated paperboard sheet Z1.

In the aforementioned embodiment, the first backing roller 5 and the second backing rollers 7 each consist of a rotatable cylindrical roller body covered, on its outer peripheral surface, with a hard urethane material having a predetermined thickness and are placed to contact with the metal roll surfaces 2A2 and 2B2 of the corresponding feed rolls. The invention is however not limited thereto. For instance, the first backing roller 5 and the second backing rollers 7 may be configured such that an inner peripheral surface of an annular roller body contacts with the metal roll surface of each feed roll. This is because the first backing roller 5 and the second backing rollers 7 have only to restrict the vibration of the corresponding feed rolls in a direction perpendicular to the axial direction. In this case, each of the first backing roller 5 and the second backing rollers 7 is preferably provided with a hard urethane material having a predetermined thickness covering the inner peripheral surface.

INDUSTRIAL APPLICABILITY

The present invention is utilizable as a sheet feeder of a corrugated paperboard box making machine provided with feed rolls for feeding corrugated paperboard sheets fed downstream one by one from corrugated paperboard sheets stacked on a sheet feed table.

REFERENCE SIGNS LIST

1 Sheet feed table
2 Feed roll
2A Upper feed roll (First feed roll)
2B Lower feed roll (Second feed roll)
3 Adjusting mechanism
4 Main unit
5 First backing roller
6 Air pressure cylinder (Fluid pressure cylinder)
7 Second backing roller
10 Sheet feeder
31 Support plate
32 Eccentric cam
33 Connecting member
52 Elastic member (Hard urethane material)
2A2 Metal roll surface (Outer peripheral surface)
Z, Z1 Corrugated paperboard sheet
W Feeding direction
θ Inclined angle

What is claimed is:

1. A sheet feeder of a corrugated paperboard box making machine, said sheet feeder including: a sheet feed table, feed rolls, a backing roller, and a main unit, said feed rolls being placed in said main unit in upper and lower opposite positions to feed downstream a corrugated paperboard sheet fed one by one from corrugated paperboard sheets stacked on said sheet feed table, and said sheet feeder further including an adjusting mechanism configured to adjust a gap between said feed rolls according to differences in thickness and flute shape of said corrugated paperboard sheet to be fed, wherein said adjusting mechanism includes support plates configured to pivotally support both ends of a first feed roll opposed to a second feed roll having an axis fixed to said main unit, said support plates being configured to allow an axis of said first feed roll to move with respect to said main unit, and said support plates support a first backing roller via a connecting member connecting said support plates so that said first backing roller contacts with an outer peripheral surface of said first feed roll.

2. The sheet feeder of a corrugated paperboard box making machine according to claim 1, wherein said first backing roller is opposed to said first feed roll at a predetermined inclined angle to a feeding direction of said corrugated paperboard sheets.

3. The sheet feeder of a corrugated paperboard box making machine according to claim 1, wherein said first backing roller is covered, on an outer periphery thereof, with a hard urethane material.

4. The sheet feeder of corrugated paperboard box making machine according to claim 2, wherein said first backing roller is covered, on an outer periphery thereof, with a hard urethane material.

5. The sheet feeder of a corrugated paperboard box making machine according to claim 1, wherein said first backing roller contacts with at least one portion of an outer peripheral surface of a central part of said first feed roll in an axial direction.

6. The sheet feeder of corrugated paperboard box making machine according to claim 2, wherein said first backing roller contacts with at least one portion of an outer peripheral surface of a central part of said first feed roll in an axial direction.

7. The sheet feeder of corrugated paperboard box making machine according to claim 3, wherein said first backing roller contacts with at least one portion of an outer peripheral surface of a central part of said first feed roll in an axial direction.

8. The sheet feeder of corrugated paperboard box making machine according to claim 4, wherein said first backing roller contacts with at least one portion of an outer peripheral surface of a central part of said first feed roll in an axial direction.

9. The sheet feeder of a corrugated paperboard box making machine according to claim 1, wherein each of said support plates has a front end portion pivotally supported by said main unit and a rear end portion connected to a fluid pressure cylinder supported by said main unit.

10. The sheet feeder of corrugated paperboard box making machine according to claim 2, wherein each of said support plates has a front end portion pivotally supported by said main unit and a rear end portion connected to a fluid pressure cylinder supported by said main unit.

11. The sheet feeder of corrugated paperboard box making machine according to claim 3, wherein each of said support plates has a front end portion pivotally supported by said main unit and a rear end portion connected to a fluid pressure cylinder supported by said main unit.

12. The sheet feeder of corrugated paperboard box making machine according to claim 4, wherein each of said support plates has a front end portion pivotally supported by said main unit and a rear end portion connected to a fluid pressure cylinder supported by said main unit.

13. The sheet feeder of corrugated paperboard box making machine according to claim 5, wherein each of said support plates has a front end portion pivotally supported by said main unit and a rear end portion connected to a fluid pressure cylinder supported by said main unit.

14. The sheet feeder of corrugated paperboard box making machine according to claim 6, wherein each of said support plates has a front end portion pivotally supported by said main unit and a rear end portion connected to a fluid pressure cylinder supported by said main unit.

15. The sheet feeder of corrugated paperboard box making machine according to claim 7, wherein each of said support plates has a front end portion pivotally supported by said main unit and a rear end portion connected to a fluid pressure cylinder supported by said main unit.

16. The sheet feeder of corrugated paperboard box making machine according to claim 8, wherein each of said support plates has a front end portion pivotally supported by said main unit and a rear end portion connected to a fluid pressure cylinder supported by said main unit.

17. The sheet feeder of a corrugated paperboard box making machine according to claim 1, further including eccentric cams pivotally supported by said main unit and placed in contact one each with said support plates to move said support plates in an up-down direction when said eccentric cams are rotated.

18. The sheet feeder of corrugated paperboard box making machine according to claim 2, further including eccentric cams pivotally supported by said main unit and placed in contact one each with said support plates to move said support plates in an up-down direction when said eccentric cams are rotated.

19. The sheet feeder of corrugated paperboard box making machine according to claim 3, further including eccentric cams pivotally supported by said main unit and placed in contact one each with said support plates to move said support plates in an up-down direction when said eccentric cams are rotated.

20. The sheet feeder of corrugated paperboard box making machine according to claim 16, further including eccentric cams pivotally supported by said main unit and placed in contact one each with said support plates to move said support plates in an up-down direction when said eccentric cams are rotated.

* * * * *